US007043778B1

(12) United States Patent
Georgitsis et al.

(10) Patent No.: US 7,043,778 B1
(45) Date of Patent: May 16, 2006

(54) APPARATUS FOR CRIB ATTACHMENT

(76) Inventors: Barbara Georgitsis, P.O. Box 1291, New London, NH (US) 03257; Vasilios Georgitsis, P.O. Box 1291, New London, NH (US) 03257

( * ) Notice: Subject to any disclaimer, the term of this patent is extended or adjusted under 35 U.S.C. 154(b) by 0 days.

(21) Appl. No.: 11/148,017

(22) Filed: Jun. 9, 2005

(51) Int. Cl.
*A47D 15/00* (2006.01)
*A47B 23/02* (2006.01)

(52) U.S. Cl. ..... 5/93.1; 5/507.1; 211/74; 108/49

(58) Field of Classification Search ..... 5/93.1, 5/658, 503.1, 507.1, 922; 211/74, 88.01, 211/126.1; 108/26, 49
See application file for complete search history.

(56) References Cited

U.S. PATENT DOCUMENTS 773,252 A * 10/1904 Frank ..... 248/104
932,128 A * 8/1909 Houston ..... 248/104
932,236 A 8/1909 Appleton
1,013,221 A * 1/1912 Roush ..... 248/102
1,084,427 A * 1/1914 Hanks ..... 248/103
1,136,529 A * 4/1915 Hopwood ..... 248/102
1,339,018 A * 5/1920 Boyce ..... 248/103
1,435,217 A * 11/1922 Davison ..... 248/103
1,559,740 A * 11/1925 Cardarella ..... 248/102
1,739,909 A * 12/1929 Livergood ..... 248/104
1,900,691 A * 3/1933 Carlson ..... 248/102
1,970,602 A * 8/1934 Geistlinger ..... 248/103
1,987,132 A * 1/1935 Shine ..... 248/104
2,060,194 A * 11/1936 Gissubel ..... 248/102
2,084,243 A * 6/1937 Charles ..... 248/102
2,110,037 A * 3/1938 De Rosa ..... 248/104
2,182,164 A * 12/1939 Rosenberg ..... 248/104
2,183,332 A * 12/1939 Haritos ..... 248/104
2,214,882 A * 9/1940 Eades ..... 248/102
2,258,076 A * 10/1941 Taylor et al. ..... 248/104
2,362,020 A * 11/1944 Morrow ..... 248/102
2,399,320 A * 4/1946 Brose et al. ..... 248/104
2,448,189 A * 8/1948 Mott ..... 248/104
2,459,546 A * 1/1949 Seiden ..... 248/103
2,490,207 A * 12/1949 Cassile ..... 248/102
2,514,134 A * 7/1950 Mann ..... 248/102
2,518,862 A * 8/1950 Cain et al. ..... 248/104
2,670,165 A * 2/1954 Dominguez ..... 248/103
2,711,872 A * 6/1955 Lampke ..... 248/103
2,766,087 A * 10/1956 Marcus ..... 108/49
2,803,417 A * 8/1957 Gruber ..... 248/103
2,830,781 A * 4/1958 Coulter ..... 248/103
2,889,051 A * 6/1959 Kramer ..... 211/74
3,078,478 A * 2/1963 Sheahan ..... 5/93.1
3,082,985 A * 3/1963 Herdman ..... 248/103
3,135,392 A * 6/1964 Elkins ..... 211/86.01
3,161,392 A * 12/1964 Kopec et al. ..... 248/104
3,180,600 A * 4/1965 Kopec ..... 248/104
3,233,563 A * 2/1966 Mauchline ..... 108/44
3,400,829 A 9/1968 Youngson (Continued)

OTHER PUBLICATIONS

Gershman, Maurice, M.D. "Self-Adhering Nylon Tapes." Journal of A.M.A. (vol. 168, No. 7) Oct. 18, 1958.*

*Primary Examiner*—Robert G. Santos

(57) ABSTRACT

The Crib Attachment can be used to fulfill the need to provide a means to easily access the required items for a baby's care and/or other items need by a cargiver. The crib attachment can be attached to the outer side of the crib and can be used to hold items that are used regularly for a baby's care.

1 Claim, 2 Drawing Sheets

U.S. PATENT DOCUMENTS 3,410,512 A * 11/1968 Del Vecchio et al. ..... 248/104
3,425,653 A * 2/1969 Rauch ..... 248/104
3,627,244 A * 12/1971 Nicholas ..... 248/103
3,696,233 A * 10/1972 Pulsifer ..... 219/535
3,706,105 A * 12/1972 Nicholas et al. ..... 5/93.1
4,062,510 A * 12/1977 Brochu ..... 248/102
4,114,847 A * 9/1978 Bogensberger ..... 248/104
4,339,061 A 7/1982 Dunn
4,560,128 A * 12/1985 Willeby et al. ..... 248/230.4
D283,185 S 4/1986 Frazier
4,616,795 A 10/1986 Bender
4,858,796 A * 8/1989 Roth ..... 224/482
5,148,561 A 9/1992 Tharalson
5,257,765 A * 11/1993 Halle ..... 248/222.13
5,419,265 A * 5/1995 Zimmerman ..... 108/45
5,458,394 A * 10/1995 Nichols et al. ..... 297/173
5,613,657 A * 3/1997 Olaiz ..... 248/102
5,699,564 A 12/1997 Heh
5,967,345 A 10/1999 Subotin
D415,995 S * 11/1999 Kanehl, Jr. ..... D12/419
6,253,399 B1 7/2001 Wagner
6,298,793 B1 * 10/2001 Turner et al. ..... 108/26
6,467,839 B1 * 10/2002 Kain ..... 297/188.14
6,484,989 B1 * 11/2002 Connery ..... 248/311.2

* cited by examiner

APPARATUS FOR CRIB ATTACHMENT

1. FIELD

The present disclosure pertains to an apparatus for Crib Attachment, in particular to provide an easy way to store or hold various baby accessories for easy access to the caregiver.

2. DESCRIPTION OF RELATED ART

The persistent need for an efficient method to easily access, accessories needed by a baby, while providing care is understood by any baby caregiver. Various methods have been invented in the past to provide a method to easily access baby accessories:

Some of the prior patents are U.S. Pat. Nos. 3,400,829, 932,236, 4,339,061, 6,253,399, 4,616,795.

However, it has been found that the inventions related to prior patents are structurally and functionally different than the present one. For example, some of the prior patents have crib attachments that are bag shaped and manufactured from cloth, thus making it hard to maintain a proper shape and also making it hard in accessing things from the attachment. Other prior patents have designs where the attachment is along with the caregiver's bed, thus making it necessary for the crib to remain in the caregiver's room for accessing the required items.

3. BRIEF DESCRIPTION OF THE FIGURES

The present invention is illustrated by way of an example and is not limited by the figures presented in the following sections:

FIG. 1 illustrates the prototype of one type of the embodiment, which is the Crib Attachment. It shows the isometric view of the embodiment, which is the Crib Attachment attached to the outside of a crib. FIG. 1 illustrates the present invention, which is the crib tray 101 attached to the outside of the crib 102 using hooks-and-loop fasteners 103, and is divided into two portions, a narrow portion which has the insulated bottle/cup insert 104, and a wider flat area 104 to place items such as a pacifier, nail clippers, baby monitor, tissue, and a bib/towel holder (plastic hook) 105 on one side of the attachment.

4. DETAILED DESCRIPTION

The following description provides an apparatus for Crib Attachment, in particular to provide an easy way to store or hold various baby accessories for easy access to the caregiver. The following sections provide a description of the apparatus for Crib Attachment, its specific details, its features and its advantages over the other prior models.

Figure 1:
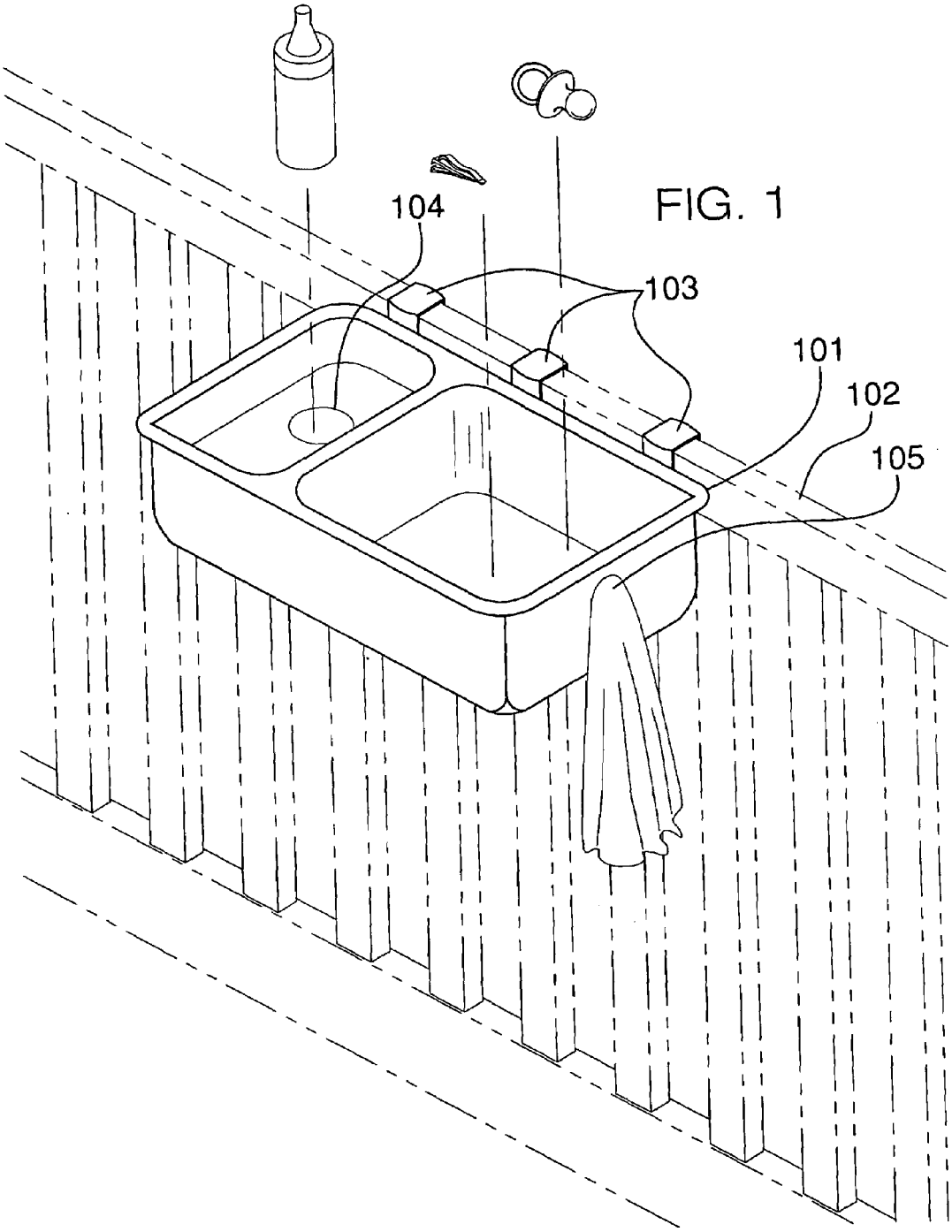

As previously discussed, some of the prior patents have crib attachments that are manufactured from cloth, thus making it hard to maintain a proper shape and also making it hard in accessing things from the attachment. Other prior patents have designs where the attachment is along with the caregiver's bed, thus making it necessary for the crib to remain in the caregiver's room for accessing the required items. The apparatus described as an embodiment in FIG. 1 is structurally different from all prior patents. It is an objective of this invention to provide an improved tray-like attachment for baby cribs, which could store baby care supplies and keep them within easy reach while caring for a baby. Another objective of this invention is to provide an attachment that can be quickly and easily moved to various positions on the baby crib without damaging the finish of the crib. Another object of this invention is to provide a versatile crib attachment that can be attached to cribs of all sizes. Another objective of this invention is to provide a new and improved crib attachment that is simple to construct, is inexpensive, is sanitary and can be easily cleaned and is pleasing in appearance. Another object of this invention is to provide an insulated bottle/cup insert to hold bottles or cups and to keep it cool or warm. Another objective of this invention is to provide a means for the caregiver to easily and safely access the required items without having to leave the baby unattended. In one embodiment, the hook-and-loop fasteners are used to attach the crib tray directly to the top rail of the crib. The smaller side of the tray could be insulated to hold bottles or cups and the longer side could be used to store other baby care accessories or items used by the caregiver such as a cordless telephone.

The apparatus for Crib Attachment, described in the present invention is easy to manufacture, is easy to install, has a simple design, is practical, and is easy to use and can be produced in different colors, sizes, and shapes to match the decor of the crib.

FIG. 1 illustrates the prototype of one type of the embodiment, which is the Crib Attachment. It shows the isometric view of the embodiment, which is the Crib Attachment attached to the outside of a crib. FIG. 1 illustrates the present invention, which is the crib tray 101 attached to the outside of the crib 102 using hook-and-loop fasteners 103, and is divided into two portions, a narrow portion which has the insulated bottle/cup insert 104, and a wider flat area 104 to place items such as a pacifier, nail clippers, baby monitor, tissue, and a bib/towel holder (plastic hook) 105 on one side of the attachment. In one embodiment, the crib tray 101 is attached to the top rail of the crib 102. If manufactured, for example, the apparatus would be rectangular in shape and would measure 9 inches in length, 4 inches in width, and 4 inches in height. The inside of the apparatus comprises of the smaller side, which would measure 3.5 inches in length, and the longer side, which would measure 5.5 inches in length. The smaller side also features an insulated bottle/cup holder 104, which can be used to keep a bottle/cup and also to keep its contents cool or warm. The longer side could be used to store baby accessories such as pacifiers, small toys, nail clippers, etc. The outside of the tray also features bib/towel holder (plastic hook) 105 on one side of the tray, which could be used to hold towels, bib or other items.

Figure 2:
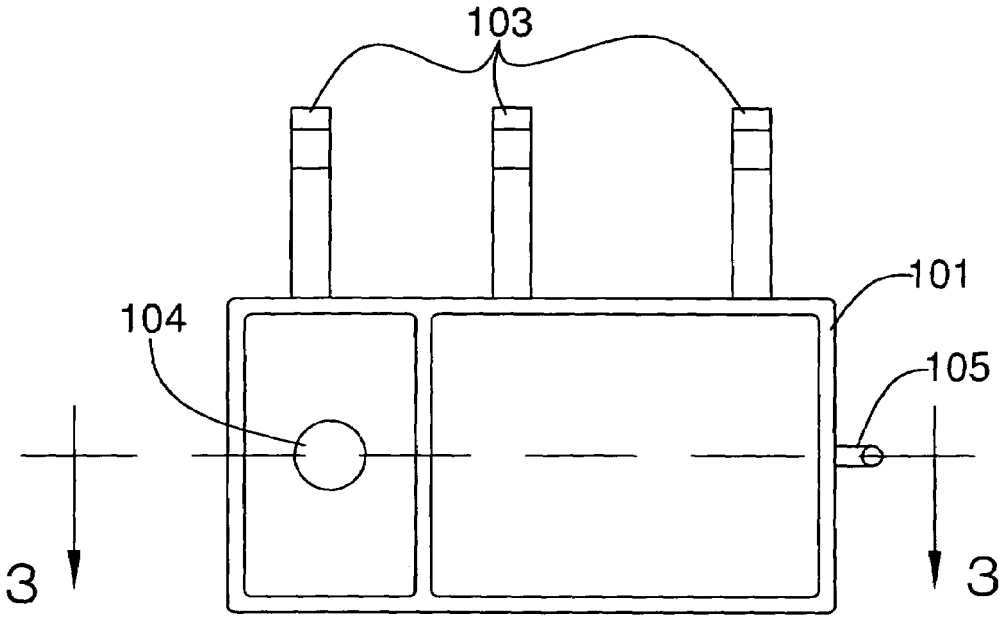
FIG. 2 illustrates the top view of the embodiment described in this present invention. This figure displays the parts such as hooks-and-loop fasteners 103, insulated bottle/cup insert 104, and the bib/towel holder (plastic hook) 105.

FIG. 2 illustrates the top view of the embodiment described in this present invention. This figure displays the parts such as hook-and-loop fasteners 103, insulated bottle/cup insert 104, and the bib/towel holder (plastic hook) 105. The crib tray 101 is attached to the outside of the crib 102 using hook-and-loop fasteners 103. The insulated bottle insert 104 is found on the smaller side of the tray and can be used to keep the contents of a bottle or cup warm. The bib/towel holder 105 which can be found on one side of the tray can be used to hang small towels or the baby's bib.

Figure 3:
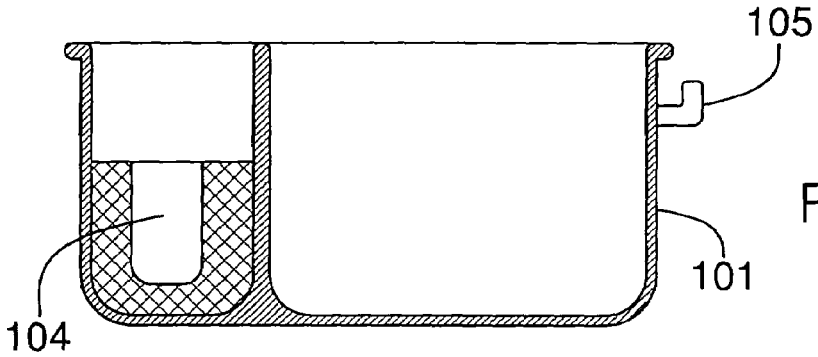
FIG. 3 illustrates the front view of the embodiment, which displays the insulated bottle/cup insert 104 and the bib/towel holder (plastic hook) 105.

FIG. 3 illustrates the front view of the embodiment, which displays the insulated bottle/cup insert 104 and the bib/towel holder (plastic hook) 105. The insulated bottle/cup insert 104 is found on the smaller side of the tray and can be used to keep the contents of a bottle or cup cool or warm. The bib/towel holder (plastic hook) 105 which can be found on one side of the tray can be used to hang small towels or the baby's bib.

Figure 4:
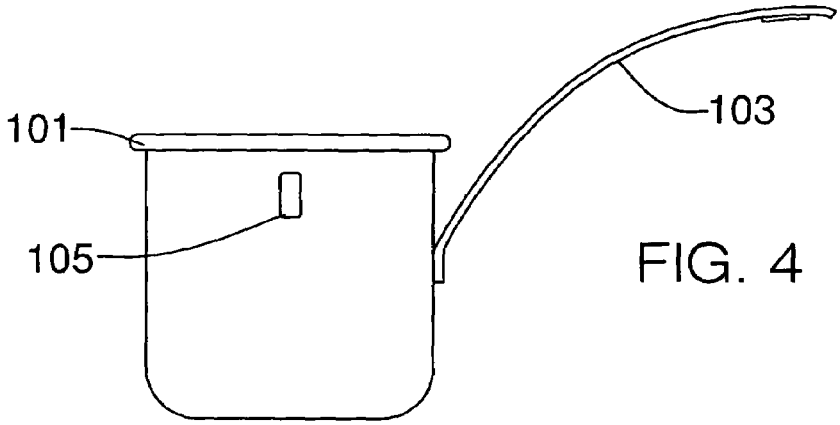
FIG. 4 illustrates the side view of the front of the embodiment and displays the hooks-and-loop fasteners 103.

FIG. 4 illustrates the side view of the front of the embodiment and displays the hook-and-loop fasteners 103. The crib tray 101 is attached to the outside of the crib 102 using hook-and-loop fasteners 103.

While certain exemplary embodiments have been shown and described in the accompanying drawings, it is to be understood that such embodiments are merely illustrative of and not restrictive of the broad invention, and that this invention not be limited to the specific size constructions and arrangements shown and described, since various other modification(s) may occur to those ordinarily skilled in the art upon studying this disclosure.

The invention claimed is:

1. An apparatus for a crib storage tray comprising:

the crib tray that is attached to an outside of a crib with hook-and-loop fasteners;

the crib tray with a fixed first and a fixed second portion, the first portion is narrower than the second portion and is separated from the second section by a deep plastic wall, wherein the first portion has an insulated bottle or cup insert;

the second portion with a flat area to place baby items; and a plastic hook to hold either a bib or towel that is on one side of the crib tray.

* * * * *